US007201618B2

(12) United States Patent
Ellis et al.

(10) Patent No.: US 7,201,618 B2
(45) Date of Patent: Apr. 10, 2007

(54) CONTROLLED MODE CONVERSION CONNECTOR FOR REDUCED ALIEN CROSSTALK

(75) Inventors: Thomas Ellis, Dallas, TX (US); Wayne Larsen, Wylie, TX (US); Amid I. Hashim, Plano, TX (US); Julian Pharney, Indianapolis, IN (US)

(73) Assignee: CommScope Solutions Properties, LLC, Sparks, NV (US)

( * ) Notice: Subject to any disclaimer, the term of this patent is extended or adjusted under 35 U.S.C. 154(b) by 0 days.

(21) Appl. No.: 11/340,368

(22) Filed: Jan. 26, 2006

(65) Prior Publication Data

US 2006/0189215 A1 Aug. 24, 2006

Related U.S. Application Data

(60) Provisional application No. 60/648,002, filed on Jan. 28, 2005.

(51) Int. Cl.
*H01R 24/00* (2006.01)

(52) U.S. Cl. ..... 439/941; 439/676

(58) Field of Classification Search ..... 439/941, 439/676

See application file for complete search history.

(56) References Cited

U.S. PATENT DOCUMENTS

| | | | |
|---|---|---|---|
| 5,186,647 | A | 2/1993 | Denkmann et al. |
| 5,299,956 | A | 4/1994 | Brownell et al. |
| 5,310,363 | A | 5/1994 | Brownell et al. |
| 5,326,284 | A | 7/1994 | Bohbot et al. |
| 5,328,390 | A | 7/1994 | Johnston et al. |
| 5,362,257 | A | 11/1994 | Neal et al. |
| 5,397,862 | A | 3/1995 | Bockelman et al. |
| 5,414,393 | A | 5/1995 | Rose et al. |
| 5,432,484 | A | 7/1995 | Klas et al. |
| 5,547,405 | A | 8/1996 | Pinney et al. |

(Continued)

FOREIGN PATENT DOCUMENTS

| | | |
|---|---|---|
| EP | 0 525 703 B1 | 2/1993 |

(Continued)

OTHER PUBLICATIONS

International Search Report for PCT/US2006/002936 dated May 15, 2006.

(Continued)

*Primary Examiner*—Truc T. Nguyen
(74) *Attorney, Agent, or Firm*—Myers Bigel Sibley & Sajovec

(57) ABSTRACT

A telecommunications connector includes first and second pairs of electrical conductors. The first and second pairs of conductors are arranged in one region of the connector such that one conductor of the first pair is selectively positioned to be closer to both of the conductors of the second pair than is the other conductor of the first pair, and such that the one conductor of the first pair couples a common mode signal of a first polarity onto the conductors of the second pair. In another region of the connector the other conductor of the first pair is selectively positioned to be closer to both of the conductors of the second pair to asymmetrically couple a common mode signal of a second polarity onto the conductors of the second pair.

29 Claims, 10 Drawing Sheets

U.S. PATENT DOCUMENTS

| | | | |
|---|---|---|---|
| 5,571,035 | A | 11/1996 | Ferrill |
| 5,618,185 | A | 4/1997 | Aikins |
| 5,779,503 | A | 7/1998 | Tremblay et al. |
| 5,911,602 | A | 6/1999 | Vaden |
| 5,915,989 | A | 6/1999 | Adriaenssens et al. |
| 5,921,818 | A | 7/1999 | Larsen et al. |
| 5,947,772 | A | 9/1999 | Arnett et al. |
| 5,961,354 | A | 10/1999 | Hashim |
| 5,971,813 | A | 10/1999 | Kunz et al. |
| 5,975,919 | A | 11/1999 | Arnett et al. |
| 5,989,071 | A | 11/1999 | Larsen et al. |
| 5,997,358 | A | 12/1999 | Adriaenssens et al. |
| 6,017,247 | A | 1/2000 | Gwiazdowski |
| 6,042,427 | A | 3/2000 | Adriaenssens et al. |
| 6,050,843 | A | 4/2000 | Adriaenssens et al. |
| 6,102,730 | A | 8/2000 | Kjeidahl et al. |
| 6,116,964 | A | 9/2000 | Goodrich et al. |
| 6,120,330 | A | 9/2000 | Gwiazdowski |
| 6,165,023 | A | 12/2000 | Troutman et al. |
| 6,170,154 | B1 | 1/2001 | Swarup |
| 6,186,834 | B1 | 2/2001 | Arnett et al. |
| 6,196,880 | B1 | 3/2001 | Goodrich et al. |
| 6,238,235 | B1 | 5/2001 | Shavit et al. |
| 6,270,358 | B1 | 8/2001 | Nozick |
| 6,270,381 | B1 | 8/2001 | Adriaenssens et al. |
| 6,312,290 | B1 | 11/2001 | Belopolsky |
| 6,350,158 | B1 | 2/2002 | Arnett et al. |
| 6,353,540 | B1 | 3/2002 | Narizuka et al. |
| 6,356,162 | B1 | 3/2002 | Deflandre et al. |
| 6,364,694 | B1 | 4/2002 | Lien |
| 6,379,157 | B1 | 4/2002 | Curry et al. |
| 6,379,198 | B1 | 4/2002 | Arnett et al. |
| 6,407,542 | B1 | 6/2002 | Conte |
| 6,428,362 | B1 | 8/2002 | Phommachanh |
| 6,443,776 | B2 | 9/2002 | Reichle |
| 6,443,777 | B1 | 9/2002 | McCurdy et al. |
| 6,454,541 | B1 | 9/2002 | Ijiri et al. |
| 6,464,529 | B1 | 10/2002 | Jensen et al. |
| 6,520,807 | B2 | 2/2003 | Winings |
| 6,524,128 | B2 | 2/2003 | Marowsky et al. |
| 6,530,810 | B2 | 3/2003 | Goodrich |
| 6,558,204 | B1 | 5/2003 | Weatherley |
| 6,558,207 | B1 | 5/2003 | Pepe et al. |
| 6,561,838 | B1 | 5/2003 | Blichfeldt |
| 6,571,187 | B1 | 5/2003 | Conte |
| 6,592,395 | B2 | 7/2003 | Brown et al. |
| 6,647,357 | B1 | 11/2003 | Conte |
| 6,764,348 | B2 * | 7/2004 | Han et al. ..... 439/676 |
| 6,811,442 | B1 | 11/2004 | Lien et al. |
| 6,962,503 | B2 | 11/2005 | Aekins |
| 2001/0018287 | A1 | 8/2001 | Reichie |
| 2001/0021608 | A1 | 9/2001 | Borbolla et al. |
| 2001/0048592 | A1 | 12/2001 | Nimomiya |
| 2002/0088977 | A1 | 7/2002 | Mori et al. |
| 2003/0129880 | A1 | 7/2003 | Arnett et al. |
| 2004/0002267 | A1 | 1/2004 | Hatterscheld et al. |
| 2005/0264223 | A1 | 11/2005 | Hashim |
| 2006/0121788 | A1 | 6/2006 | Pharney |
| 2006/0121789 | A1 | 6/2006 | Hashim |
| 2006/0160428 | A1 | 7/2006 | Hashim |

FOREIGN PATENT DOCUMENTS

| | | |
|---|---|---|
| EP | 0 901 201 | 3/1999 |
| EP | 1 059 704 | 12/2000 |
| EP | 1 191 646 | 3/2002 |
| EP | 1 435 679 | 7/2004 |
| WO | 94/05092 | 3/1994 |
| WO | WO 99/53574 | 10/1999 |
| WO | 2003-019734 | 3/2003 |
| WO | 03/090322 | 10/2003 |

OTHER PUBLICATIONS

Belden CDT Networking Data Sheet for the 10GX Module www.BeidenlBDN.com.

* cited by examiner

CONTROLLED MODE CONVERSION CONNECTOR FOR REDUCED ALIEN CROSSTALK

RELATED APPLICATIONS

This application claims priority from U.S. Provisional Patent Application Ser. No. 60/648,002, filed Jan. 28, 2005, entitled CONTROLLED MODE CONVERSION PLUG FOR REDUCED ALIEN CROSSTALK and U.S. patent application Ser. No. 11/051,305, filed Feb. 4, 2005 the disclosures of each of which are hereby incorporated herein by reference, in their entireties.

FIELD OF THE INVENTION

The present invention relates generally to communication connectors and more particularly to near-end crosstalk (NEXT) and far-end crosstalk (FEXT) compensation in communication connectors.

BACKGROUND OF THE INVENTION

In an electrical communication system, it is sometimes advantageous to transmit information signals (e.g., video, audio, data) over a pair of wires (hereinafter "wire-pair" or "differential pair") rather than a single wire, wherein the transmitted signal comprises the voltage difference between the wires without regard to the absolute voltages present. Each wire in a wire-pair is susceptible to picking up electrical noise from sources such as lightning, automobile spark plugs, and radio stations, to name but a few. Because this type of noise is common to both wires within a pair, the differential signal is typically not disturbed. This is a fundamental reason for having closely spaced differential pairs.

Of greater concern, however, is the electrical noise that is picked up from nearby wires or pairs of wires that may extend in the same general direction for some distances and not cancel differentially on the victim pair. This is referred to as "crosstalk." Particularly, in a communication system involving networked computers, channels are formed by cascading plugs, jacks and cable segments. In such channels, a modular plug (see, e.g., plug 10 and entering cable 20 in FIG. 1) often mates with a modular jack, and the proximities and routings of the electrical wires (conductors) and contacting structures within the jack and/or plug also can produce capacitive as well as inductive couplings that generate near-end crosstalk (NEXT) (i.e., the crosstalk measured at an input location corresponding to a source at the same location) as well as far-end crosstalk (FEXT) (i.e., the crosstalk measured at the output location corresponding to a source at the input location). Such crosstalks can occur from closely-positioned wires.

Communication system infrastructure using the "Ethernet" standard is based on data being transmitted differentially on up to four twisted-pair transmission lines (designated as Pair 1 through Pair 4) grouped together within a common cable jacket. As described above, the transmission lines are connected with physical connectors. In order to maintain backwards-compatibility with legacy systems, the physical requirements for the connectors have been fixed by industry standards (see, e.g., TIA/EIA 568-B.2-1, FIG. 6-2 D.25). These requirements are not necessarily optimum for high speed data transmission.

For historical reasons, the four twisted pair transmission lines are arranged at the connectors such that the two wires that make up Pair 3 split apart and connect on alternate sides of Pair 1. The remaining Pairs 2 and 4 lie on either side of the split pair combination (see conductors 20*a*–20*h* and blades 30*a*–30*h* in FIG. 2). The electrical properties, in particular the degree of crosstalk between the pairs, are impacted by this physical layout.

To maintain the compatibility of components between different vendors, a "Nominal" plug response was defined and accepted as an industry standard (see, e.g., TIA/EIA 568-B.2-1). A range of allowable variation was also defined and accepted, which enables mating "jacks" to complete the connection of the twisted pair cables with resultant levels of crosstalk between the twisted-pair transmission lines reduced to some required value. This process of reducing the resultant crosstalk levels has been commonly termed "compensation" and is essentially the intentional addition of signals that sum up to be of equal magnitude but opposite sign to that of the original offending crosstalk.

The accepted levels of crosstalk for a "Nominal Plug," in particular for the Pair 1-Pair 3 combination, are fairly restrictive. As a result, little change has been made to the plug structure to improve overall system performance, although improvements in areas such as manufacturability, cost, and variability have been made. Until recently, because of the restrictive predefined crosstalk levels for the plugs, improvements in system performance have been mainly a result of compensation techniques in the jack receptacle.

As data transmission rates have increased, a variety of system performance requirements have evolved. While the data sent through the system is still sent via the four twisted-pair transmission lines, the levels of permissible crosstalk between the pairs (i.e. interference) in a working system has decreased in spite of advances in signal processing techniques and coding schemes. In previous requirements, the levels of interference have been defined for signals within a single four-pair cable. This was because the absolute levels of interference from pairs in other physically close cables were negligible as compared to levels from other pairs internal to a single cable. However, with the new standards and high data rates that are evolving, this is no longer true. The interference received on a four-pair cable as a result of transmission on other cables or connectors has been termed "Alien Crosstalk".

Since the newly defined alien crosstalk can be generated from any unrelated data transmission, it can be difficult to use current signal processing techniques to calculate and subtract away their effects within a four-pair cable connection (referred to as a "port"). As a result, the absolute levels of alien crosstalk are lower than those allowed to exist from pairs within a cable bundle because no digital signal processing (DSP) correction is applied.

Another issue with alien crosstalk results from the fact that alien crosstalk levels vary based on a number of random factors such as how adjacent cables are bundled together, the physical proximity of the plugs and jacks within a given system, the number of cables adjacent to each other, and the like. All of these factors cannot be known a priori to the design of the compensating network. As a result of these factors, the degree to which alien crosstalk can be "corrected" for is limited, and alien crosstalk can ultimately dominate the final system performance levels.

Alien crosstalk received within a cable pair is due to that cable pair being positioned within the electromagnetic fields generated by other cables or connectors. The inherent structure of these fields determines the strength of the crosstalk signals that are ultimately induced. As a result, increasing the physical separation between the conductor pairs usually results in decreased levels of crosstalk due to the inverse relationship between field strength and distance from the source.

The field structure of a transmission line is determined mainly by its cross-sectional structure. For a two-conductor transmission line, increasing the separation between conductors generally causes the field patterns to become more spread out, which can result in increased levels of crosstalk for a fixed physical separation between cables.

As previously explained, the physical structure of the Nominal Plug is limited by the constraints placed on the internal crosstalk parameters. This physical structure does not maintain symmetry between the four pairs internal to a cable. As a result, a differential signal transmitted on Pair 3 will couple different absolute voltage levels onto Pair 2 and Pair 4. The differential signal on Pair 3 is said to couple a "common" voltage onto Pair 2 and Pair 4. However, the two "common mode" signals coupled to the outer pairs results in a new differential signal that uses Pair 2 as a single effective conductor and Pair 4 as the other; it is effectively another transmission line within the cable bundle. However, since the two pairs are physically separated by more distance than a single twisted pair, the resulting field structure will be less confined and therefore can cause more alien crosstalk onto nearby cable pairs than the direct crosstalk from the internal Pair 3 signal.

Given the number of conductor pairs within a cable, the number of cables in a system, the number of connectors in a system, etc., it is clear that numerous mechanisms (both direct and indirect) for alien crosstalk can exist, with the previous example being a dominant mechanism in at least some cable systems. One possible solution to the alien crosstalk problem is the use of shielded transmission line cables and connectors, commonly referred to as "foil twisted pairs" (FTP). Although shielding can be an effective solution to alien crosstalk, it is not consistent with an unshielded twisted pair installation base and is typically more expensive to manufacture and install.

SUMMARY OF THE INVENTION

As a first aspect, embodiments of the present invention are directed to a telecommunications connector. The connector comprises first and second pairs of electrical conductors. The first and second pairs of conductors are arranged in one region of the connector such that one conductor of the first pair is selectively positioned to be closer to both of the conductors of the second pair than is the other conductor of the first pair, and such that the one conductor of the first pair couples a common mode signal of a first polarity onto the conductors of the second pair. In another region of the connector the other conductor of the first pair is selectively positioned to be closer to both of the conductors of the second pair to couple a common mode signal of a second polarity onto the conductors of the second pair. In this configuration, the connector (in some embodiments a communications plug) can reduce alien crosstalk.

As a second aspect, embodiments of the present invention are directed to a communications plug. The plug comprises a plurality of conductive contacts, each of the contacts being substantially aligned and parallel with each other in a contact region of the plug, and a printed circuit board on which the contacts are mounted. The printed circuit board comprises at least one dielectric substrate and traces deposited thereon. Each of the traces is electrically connected to a respective contact, and each of the traces is adapted to connect with a respective conductor of an entering cable. The arrangement of the traces on the dielectric substrate is selected to control the differential to common mode coupling between the traces of at least two pairs of traces.

As a third aspect, embodiments of the present invention are directed to a method of controlling the signal being output by a communications plug. The method comprises positioning a first pair of conductors relative to a dielectric substrate and positioning a second pair of conductors relative to a dielectric substrate. The first and second pairs of conductors are arranged in one region of the plug such that one conductor of the first pair is selectively positioned to be closer to both of the conductors of the second pair than is the other conductor of the first pair, and such that the one conductor of the first pair couples a common mode signal of a first polarity onto the conductors of the second pair. In another region of the plug the other conductor of the first pair is selectively positioned to be closer to both of the conductors of the second pair to asymmetrically couple a common mode signal of a second polarity onto the conductors of the second pair.

As a fourth aspect, embodiments of the present invention are directed to a telecommunications plug, comprising: a first conductor and a second conductor that are adjacent to one another in a contact region of the plug and that together form a second pair of conductors; a fourth and a fifth conductor that are adjacent to each other in the contact region of the plug and that together form a first pair of conductors; a third conductor that is disposed between the second conductor and the fourth conductor on the contact region of the plug; and a sixth conductor that is adjacent to the fifth conductor, the third and the sixth conductor together forming a third pair of conductors that sandwiches the first pair of conductors. The third conductor and the sixth conductor are arranged to couple substantially equal amounts of signal energy onto each of the first conductor and the second conductor, and the third conductor and the sixth conductor are arranged to couple differing amounts of signal energy onto each of the fourth and fifth conductors.

As a fifth aspect, embodiments of the present invention are directed to a method of controlling the signal being output by a communications plug when a balanced signal is applied, comprising: positioning a first pair of conductors relative to a dielectric substrate; positioning a second pair of conductors relative to a dielectric substrate; positioning a third pair of conductors relative to a dielectric substrate; and positioning a fourth pair of conductors relative to a dielectric substrate. The positions of the first, second, third and fourth pairs of conductors are selected to control differential to common mode coupling between the conductors to counteract the effects of cross-modal coupling that would otherwise exist between the conductors.

As a sixth aspect, embodiments of the present invention are directed to a telecommunications connection assembly comprising a plug and a jack that receives the plug. The plug comprises first and second pairs of electrical conductors arranged in a first plug region of the plug such that a first conductor of the first pair is selectively positioned to be closer to both of the conductors of the second pair than is a second conductor of the first pair, and in a second plug region of the plug the second conductor of the first pair is selectively positioned to be closer to both of the conductors of the second pair than the first conductor of the first pair. The jack comprises first and second pairs of electrical conductors arranged in a first jack region of the jack such that a first conductor of the first pair is selectively positioned to be closer to both of the conductors of the second pair than is a second conductor of the first pair, and in a second jack region of the jack the second conductor of the first pair is selectively positioned to be closer to both of the conductors of the second pair than the first conductor of the first pair. Each of the plug and the jack includes a contact region, the plug and jack contact regions contacting each other when the plug and jack are in a mated condition in which the conductors of the plug are electrically connected with the conductors of the jack.

DETAILED DESCRIPTION OF EMBODIMENTS OF THE PRESENT INVENTION

Figure 1:
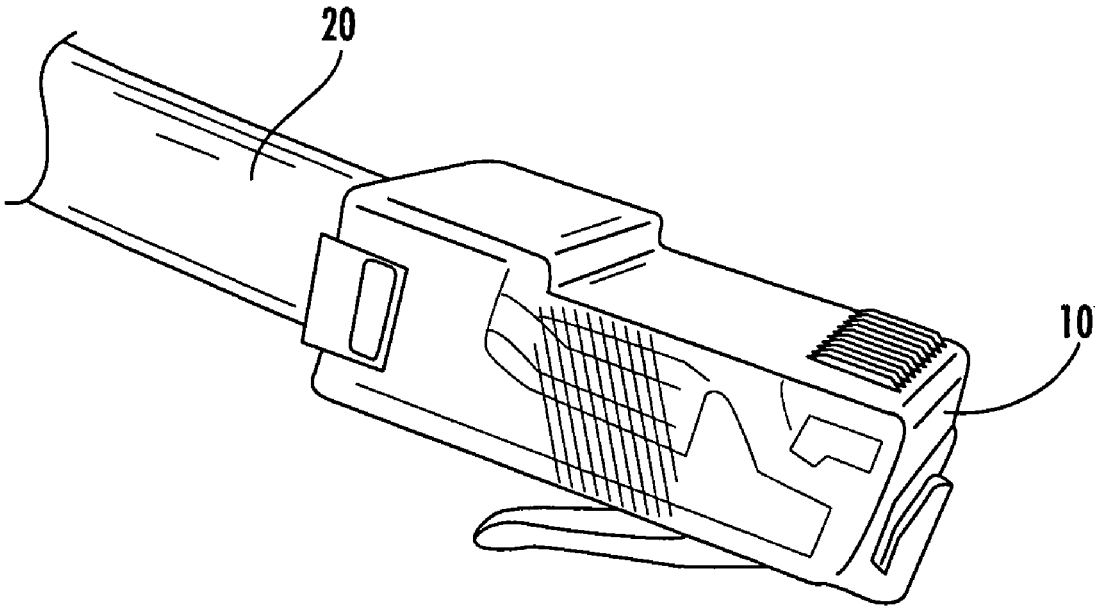
FIG. 1 is a perspective view of a communications plug according to embodiments of the present invention.
Figure 2:
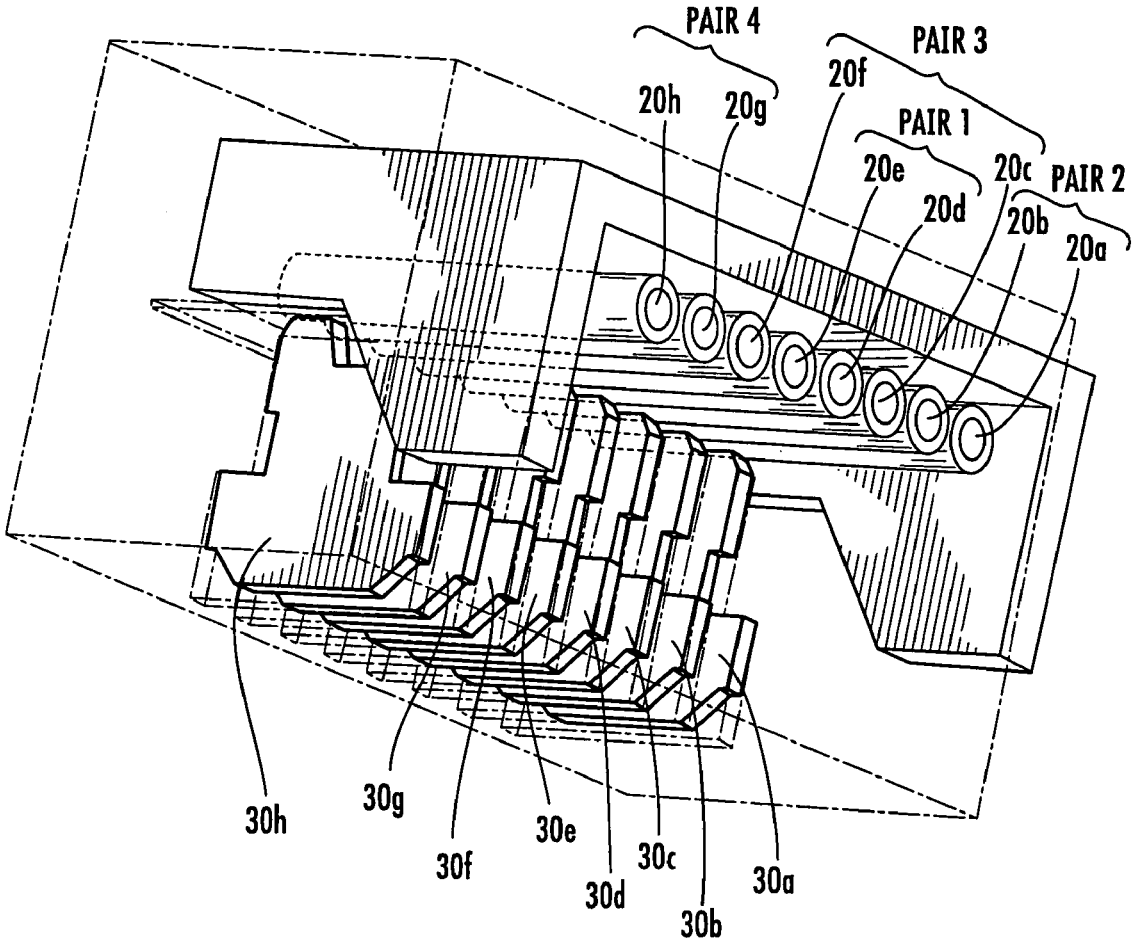
FIG. 2 is a perspective view of a set of wires and contact blades of a prior art plug.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of this invention are directed to communications connectors, with a primary example of such being a communications plug. As used herein, the terms "forward", "forwardly", and "front" and derivatives thereof refer to the direction defined by a vector extending from the center of the plug toward the output blades. Conversely, the terms "rearward", "rearwardly", and derivatives thereof refer to the direction directly opposite the forward direction; the rearward direction is defined by a vector that extends away from the blades toward the remainder of the plug. Together, the forward and rearward directions define the "longitudinal" dimension of the plug. The terms "lateral," "outward", and derivatives thereof refer to the direction generally normal with a plane that bisects the plug in the center and is parallel to the blades. The terms "medial," "inward," "inboard," and derivatives thereof refer to the direction that is the converse of the lateral direction, i.e., the direction normal to the aforementioned bisecting plane and extending from the periphery of the plug toward the bisecting plane. Together, the lateral and inward directions define the "transverse" dimension of the plug. A line normal to the longitudinal and transverse dimensions defines the "vertical" dimension of the plug.

Where used, the terms "attached", "connected", "interconnected", "contacting", "mounted" and the like can mean either direct or indirect attachment or contact between elements, unless stated otherwise. Where used, the terms "coupled," "induced" and the like can mean non-conductive interaction, either direct or indirect, between elements or between different sections of the same element, unless stated otherwise.

Undesired mode conversion is an indirect mechanism that can result in differential-to-differential mode crosstalk. It is established that the physical structure of the Nominal Plug induces common-mode conversions between pairs that may add to the alien crosstalk problem. The structure does so by inducing unwanted transmission line modes that are less confined than the wanted twisted-pair signals and, therefore, more conducive to alien crosstalk generation.

Given the complex nature of the field structure, there can be numerous different mode-conversion paths that contribute to the overall alien crosstalk problem. While these paths will typically be different for different physical structures, they can be broken down into two general categories—inductive crosstalk and capacitive crosstalk—according to the way in which the energy is transferred between conductors.

Inductive crosstalk is due to coupling of the magnetic field lines for the different modes on a conductor pair. It is described generally by Faraday's Law, which implies that the induced signal will be of the opposite sign of the source. As a result, inductively coupled signals can be directional in nature (i.e., a forward traveling signal will couple a reverse traveling signal on the induced conductor). This can cause asymmetry in the levels of forward, or "far end," crosstalk (FEXT) and reverse, or "near end," crosstalk (NEXT). In a nominal plug structure, the signals on the eight conductors all travel parallel to each other for some distance between the input of the plug and the blade contact points, so significant levels of inductive mode conversion can occur in this area.

Capacitive crosstalk is the result of the attraction and repulsion of charges on nearby conductors. Since a net negative charge on one conductor will result in an attraction of positive charge on an adjacent conductor, there is no directional dependence on the induced signal. The mechanism of capacitive induction results in levels of NEXT and FEXT to be similar in magnitude.

It should be recalled that, with the exception of some external physical dimensions and connection requirements, it is the electrical performance of the Nominal Plug that is defined by TIA/EIA 568-B.2-1, not its internal physical structure. The present invention recognizes that a Nominal Plug may be modified in such a way that the required internal crosstalk parameters are maintained or optimized while the unwanted modes that are conducive to alien crosstalk (either alone or once mated to other components) are reduced and controlled. This can be accomplished, for example, by controlling one or more sources of mode conversion in a way so as to reduce the net alien crosstalk within a system, as opposed to correcting for the crosstalk after it has occurred.

Since the cable, plug and jack assembly form a complex physical structure, many different paths exist for crosstalk to occur. In order to achieve low levels of unwanted mode conversion, both inductive and capacitive crosstalk mode conversion mechanisms should be compensated for.

While the general concepts of this invention can be implemented in a numerous ways, one specific example would include a PCB structure that provides the electrical parameters of the Nominal Plug while simultaneously reducing the unwanted coupling of energy into the undesired modes that increase alien crosstalk. In order to achieve the desired mode-conversion reduction, such a structure may compensate for mode conversion from both inductive and capacitive crosstalk.

Figure 3:
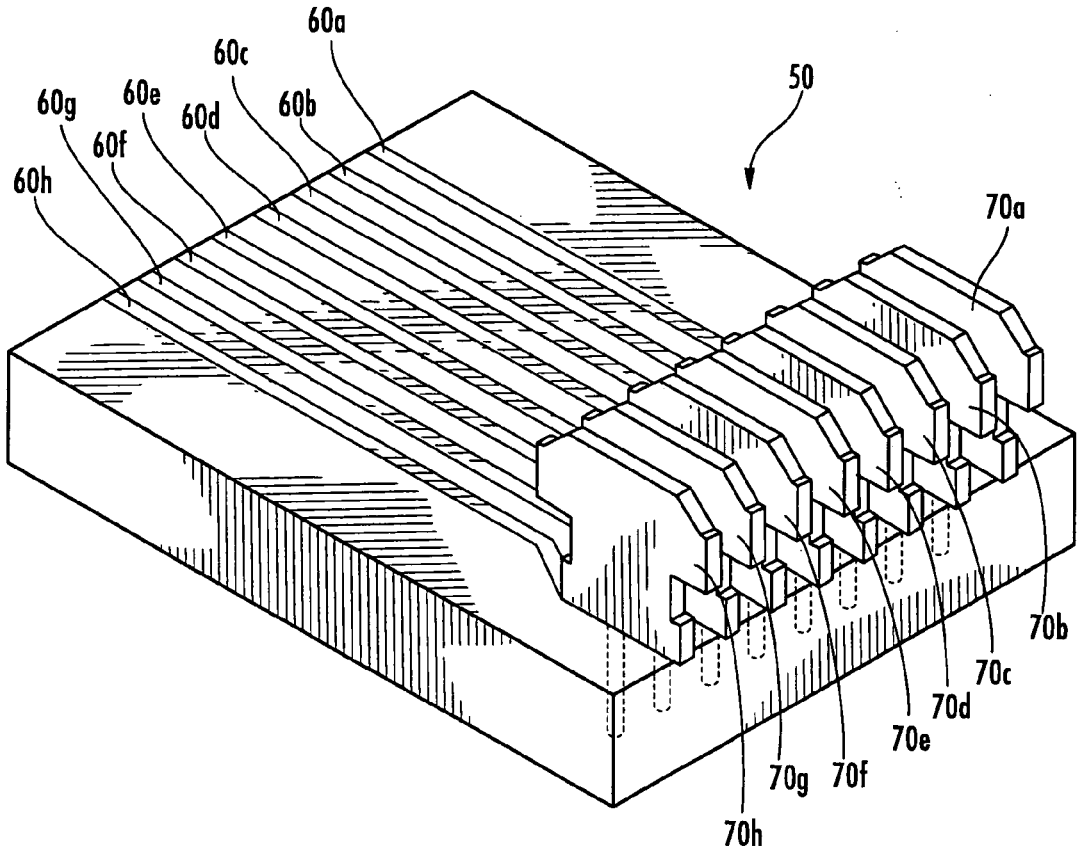
FIG. 3 is a perspective view of a printed circuit board (PCB) representing the inductive and capacitive crosstalk present in a Nominal Plug.

As a starting point, a PCB equivalent circuit 50 for a Nominal Plug is shown in FIG. 3. Parallel metal traces 60*a*–60*h* reproduce the inductive coupling in the Nominal Plug, while the blades 70*a*–70*h* create a natural capacitance in a typical plug structure. As can be seen from FIG. 3, trace 60*c*, which is one of the traces that make up Pair 3, is much closer to the traces 60*a*, 60*b* of Pair 2 than to the traces 60*g*, 60*h* of Pair 4. As a result, the "common mode" signal inductively induced from trace 60*c* of Pair 3 to Pair 2 is much stronger than that induced onto Pair 4, with the dual situation being true for the opposite trace 60*f* of Pair 3. The resulting differential signal developed between Pair 2 and Pair 4 has a greatly expanded field structure due to the separation of the signal pairs and, therefore, can be a significant contributor to alien crosstalk. It is also apparent that the capacitive coupling between the blades of Pair 3 has a similar imbalance and will result in similar mode conversion.

Figure 4A:
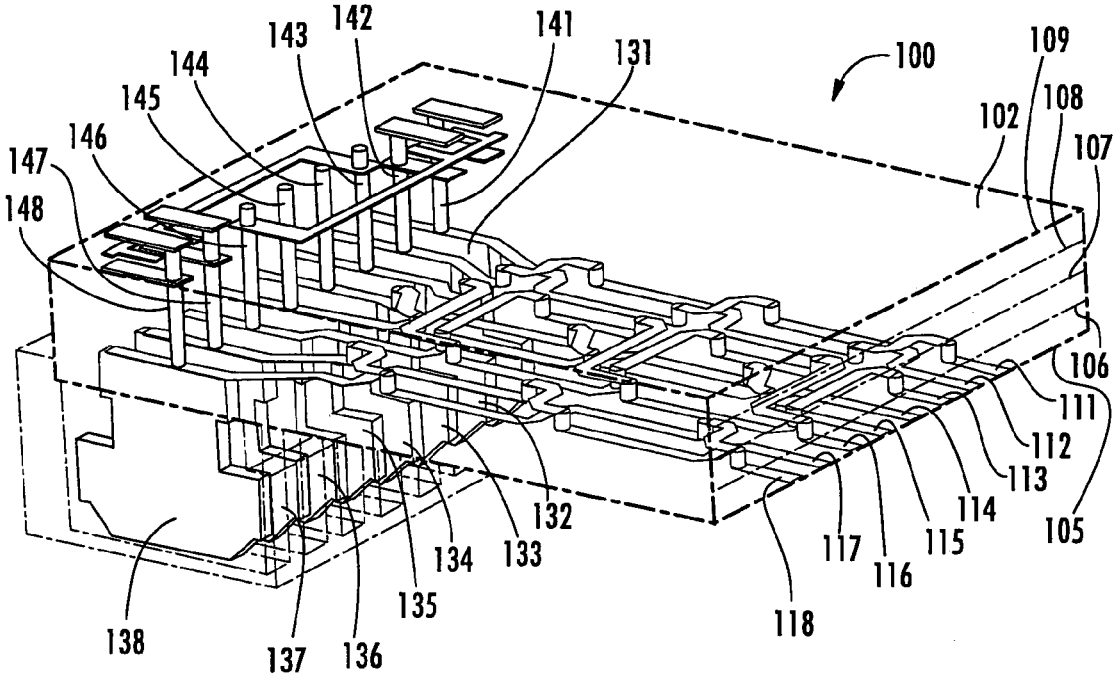
FIG. 4A is a front perspective view of a PCB according to embodiments of the present invention that can be employed with the plug of FIG. 1.
Figure 4B:
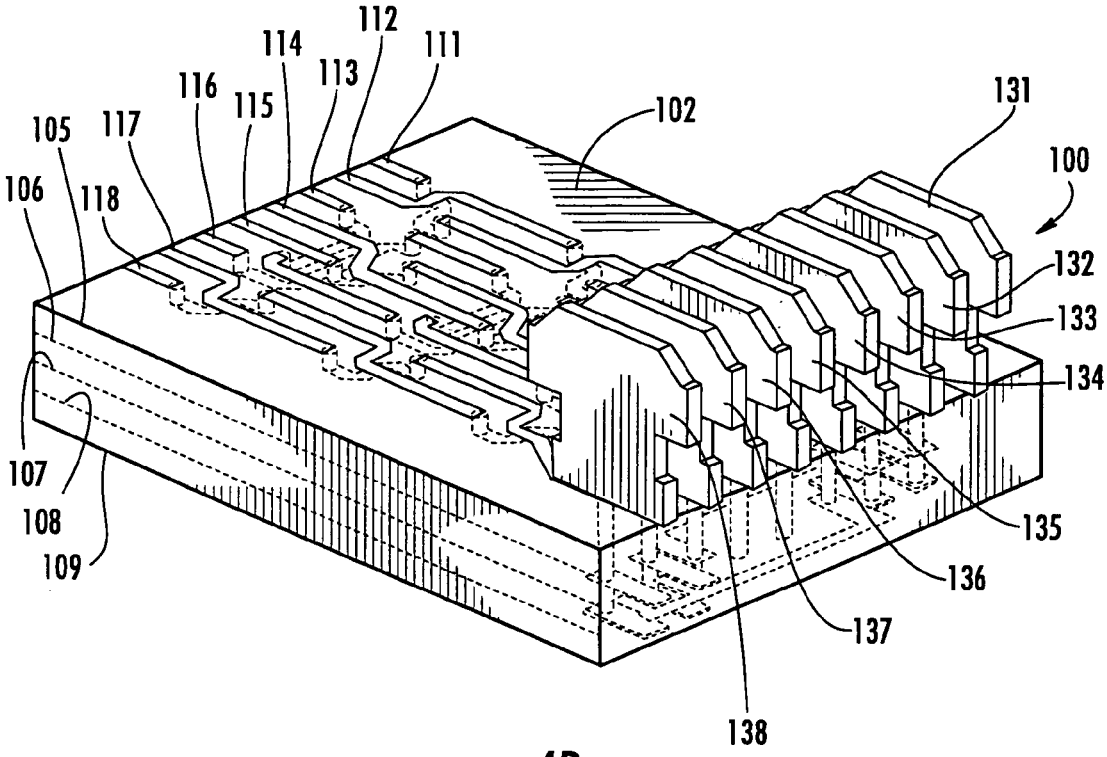
FIG. 4B is a rear perspective view of a PCB according to embodiments of the present invention that can be employed with the plug of FIG. 1.

Referring now to FIGS. 4A and 4B, a PCB 100 for inclusion in a Nominal Plug is illustrated. With a plug of this configuration, the conversions from the differential mode of Pair 3 to the common modes on Pair 2 and Pair 4 can be reduced, with the understanding that other mode conversions can also be reduced.

The PCB 100 includes a dielectric mounting substrate 102, which in this particular embodiment includes five overlying layers 105–109 formed on four dielectric boards. Electrically conductive traces are deposited on the layers 105–109 to form conductors 111–118, which are described in greater detail below. Blades 131–138 are mounted in the substrate 102 in substantially aligned, substantially parallel relationship positioned for contact with a mating jack; mounting is achieved via posts 141–148 that extend throughout the layers of the substrate 102.

Figure 5A:
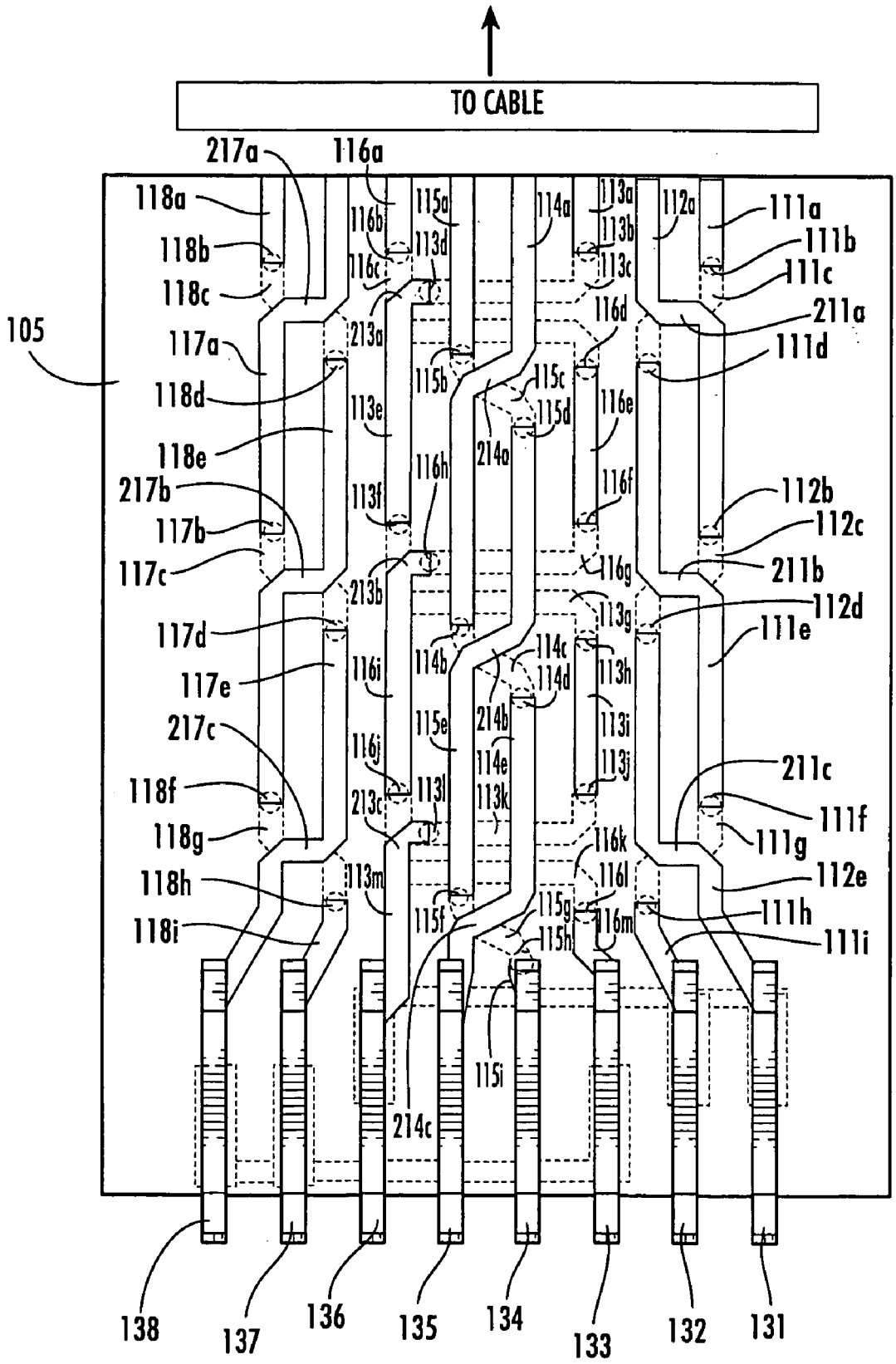
FIG. 5A is a top view of the PCB of FIGS. 4A and 4B.

Referring now to FIG. 5A, the conductors 111–118 are subdivided into individual traces and vias, which enable the conductors to be deposited on different ones of the layers 105–109. At or near one end, each conductor 111–118 is adapted to electrically connect with one of the conductors of a cable, and at the other end, each of the conductors is electrically connected with a respective one of the blades 131–138. These conductors are described in greater detail below.

The conductor 111, which forms part of Pair 2, includes a trace 111*a* that extends rearwardly on layer 105 from a contact point with a cable conductor to a via 111*b*. A crossing trace 111*c* extends generally inwardly on layer 106 from the via 111*b* to a via 111*d*. A tripartite trace 111*e* extends rearwardly, then outwardly, then rearwardly on the layer 105 between the via 111*d* to a via 111*f*. A crossing trace 111*g* extends generally inwardly on the layer 106 between the via 111*f* and a via 111*h*. A trace 111*i* extends rearwardly and slightly outwardly on layer 105 from the via 111*h* to the blade 132.

The conductor 112, which also forms part of Pair 2, includes a tripartite trace 112*a* that extends rearwardly, then outwardly, then rearwardly on layer 105 from a contact point with a cable conductor to a via 112*b*. In doing so, the trace 112*a* crosses above the trace 111*c* of the conductor 111 at a crossover 211*a*. A crossing trace 112*c* extends generally inwardly on layer 106 between the via 112*b* and a via 112*d*; in doing so, the crossing trace 112*c* passes below the trace 111*e* at a crossover 211*b*. A tripartite trace 112*e* extends rearwardly, then outwardly, then rearwardly and slightly outwardly on the layer 105 between the via 112*d* and the blade 131 and passes over trace 111*g* at a crossover 211*c*.

The conductor 113, which forms part of Pair 3, includes a trace 113*a* that extends generally rearwardly on the layer 105 from a contact point with a cable conductor to a via 113*b*. A crossing trace 113*c* extends generally transversely on the layer 106 as it is routed from the via 113*b* to a via 113*d*. A trace 113*e* extends slightly outwardly, then rearwardly on the layer 105 between the via 113*d* and a via 113*f*. A crossing trace 113*g* extends rearwardly, then transversely, then slightly rearwardly on the layer 106 between the via 113*f* and a via 113*h*. A trace 113*i* extends rearwardly on layer 105 to a via 113*j*. A crossing trace 113*k* extends slightly rearwardly, then transversely on the layer 106 between the via 113*j* and a via 1131. A trace 113*m* extends generally rearwardly on the layer 105 between the via 1131 and the blade 136.

The conductor 116, which also forms part of Pair 3, includes a trace 116*a* that extends rearwardly on the layer 105 between a contact point with a cable conductor to a via 116*b*. A crossing trace 116*c* extends rearwardly, then transversely, then slightly rearwardly on layer 106 between the via 116*b* and a via 116*d* (passing under the trace 113*e* at a crossover 213*a*). A trace 116*e* extends rearwardly on the layer 105 between the via 116*d* and a via 116*f*. A crossing trace 116*g* extends slightly rearwardly, then transversely on the layer 106 between the via 116*f* and a via 116*h*. A trace 116*i* extends slightly outwardly, then rearwardly on the layer 105 between the via 116*h* and a via 116*j* as it passes over the trace 113*g* at a crossover 213*b*. A crossing trace 116*k* extends rearwardly, then transversely, then slightly rearwardly on the layer 106 (passing below the trace 113*m* at a crossover 213*c*) between the via 116*k* and a via 116*l*. A trace 116*m* extends rearwardly and slightly outwardly on layer 105 between the via 1161 and the blade 133.

The conductor 114, which forms part of Pair 1, includes a tripartite trace 114*a* that extends rearwardly, then transversely, then further rearwardly on the layer 105 between a contact point with a cable conductor and a via 114*b*. The trace 114*a* passes over (a) traces 113*c*, 116*c* and (b) traces 113*g*, 116*g* of conductors 113, 116. A crossing trace 114*c* extends rearwardly and transversely on the layer 106 between the via 114*b* and a via 114*d*. A tripartite trace 114*e* extends rearwardly, then transversely, then further rearwardly on the layer 105 between the via 114*d* and the blade 135. The trace 114*e* passes over the traces 113*k*, 116*k* of conductors 113, 116.

The conductor 115, which also forms a part of Pair 1, includes a trace 115*a* that extends rearwardly on the layer 105 between a contact point with a cable conductor and a via 115*b*; the trace 115*a* also passes over the traces 113*c*, 116*c*. A crossing trace 115*c* extends rearwardly and transversely on the layer 106 between the via 115*b* and a via 115*d*; in doing so, the crossing trace 115*c* passes under the trace 114*a* at a crossover 214*a*. A tripartite trace 115*e* extends rearwardly, then transversely and rearwardly, then further rearwardly on layer 105 between the via 115*d* and a via 115*f*. The trace 115*e* passes over (a) the traces 113*g*, 116*g*, (b) the trace 114*c* (at a crossover 214*b*), and (c) the traces 113*k*, 116*k* of conductors 113, 116. A trace 115*g* extends rearwardly and transversely on the layer 106 between the via 115*f* and a via 115*h* and passes under the trace 114*e* at a crossover 214*c*). A short trace 115*i* extends rearwardly on layer 105 between the via 115*h* and the blade 114.

The conductor 118, which forms part of Pair 4, includes a trace 118*a* that extends rearwardly on the layer 105 from a contact point with a cable conductor to a via 118*b*. A crossing trace 118*c* extends generally inwardly on layer 106 from the via 118*b* to a via 118*d*. A tripartite trace 118*e* extends rearwardly, then outwardly, then rearwardly on the layer 105 between the via 118*d* to a via 118*f*. A crossing trace 118*g* extends generally inwardly on the layer 106 between the via 118*f* to a via 118*h*. A trace 118*i* extends rearwardly and slightly outwardly on the layer 105 from the via 118*h* to the blade 137.

The conductor 117, which also forms part of Pair 4, includes a tripartite trace 117*a* that extends rearwardly, then outwardly, then rearwardly on layer 105 from a contact point with a cable conductor to a via 117*b*. In doing so, the trace 117*a* crosses above the trace 118*c* of the conductor 118 at a crossover 217*a*. A crossing trace 117*c* extends generally inwardly on layer 106 between the via 117*b* and a via 117*d*; in doing so, the crossing trace 117*c* passes below the trace 118*e* at a crossover 217*b*. A tripartite trace 117*e* extends rearwardly, then outwardly, then rearwardly and slightly outwardly on layer 105 between the via 117*d* and the blade 138 and passes over trace 118*g* at a crossover 217*c*.

Figure 5B:
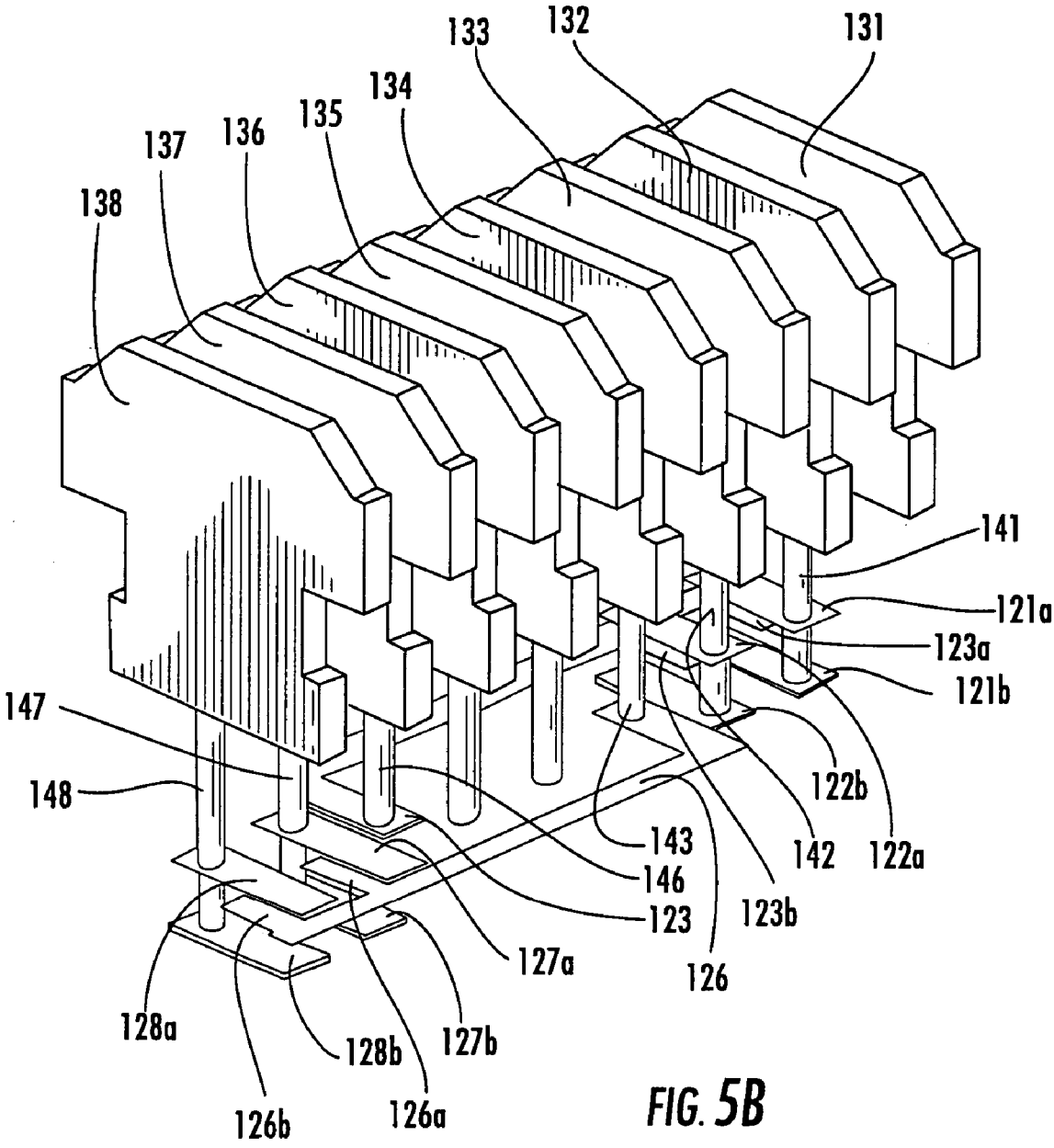
FIG. 5B is an enlarged rear perspective view of the PCB of FIGS. 4A and 4B.

Referring now to FIG. 5B, the PCB 100 also includes multiple capactitors to provide compensating capacitive coupling. In one instance, the conductors 111, 112 of Pair 2 are capacitively coupled to the conductor 113 of Pair 3 through capacitors 121, 122. Each of the capacitors 121, 122 includes a respective plate 121*a*, 122*a* mounted on the layer 107 and a respective plate 121*b*, 122*b* mounted on layer 109. Each of these plates is electrically connected to its corresponding post 141, 142. A trace 123 connected with the post 146 is mounted on layer 108 and is routed transversely toward Pair 2. A finger 123*a* extends between the plates 121*a*, 121*b*, and a finger 123*b* extends between the plates 122*a*, 122*b*. Thus, conductor 113 is capacitively coupled to the conductors 111, 112 of Pair 2.

In another instance, the conductors 117, 118 of Pair 4 are capacitively coupled to the conductor 116 of Pair 3 through capacitors 127, 128. Each of the capacitors 127, 128 includes a respective plate 127*a*, 128*a* mounted on the layer 107 and a respective plate 127*b*, 128*b* mounted on layer 109. Each of these plates is electrically connected to its corresponding post 147, 148. A trace 126 connected with the post 143 is mounted on layer 108 and is routed transversely toward Pair 4. A finger 126*a* extends between the plates 127*a*, 128*b*, and a finger 126*b* extends between the plates 127*a*, 128*b*. Thus, conductor 116 is capacitively coupled to the conductors 117, 118 of Pair 2.

In order to prevent or substantially reduce inductive crosstalk mode conversion caused by asymmetric coupling of conductors, approximately equal but opposite levels of magnetic coupling should occur between the individual conductors of Pair 3 and the conductor pairs for Pair 2, and separately Pair 4 (i.e., approximately equal common mode signals couple between each of the Pair 3 conductors to Pairs 2 and 4). Because the signal on Pair 3 is differential in nature, if the individual conductors of Pair 3 are crossed over (e.g., at crossovers 213*a*, 213*b*, 213*c*) so that they exchange positions relative to Pair 2 and Pair 4, the lengths of the substantially parallel segments between the crossovers can be adjusted such that there is no net coupling. This technique can be followed in one or more sections such that a desired bandwidth can be achieved.

As a specific example, looking at conductor 113 relative to the conductors 111, 112 of Pair 2, trace 113*a* of conductor 113 is much closer to (and therefore more closely couples with) trace 11*a* and the initial segment of trace 112*a* than is trace 116*a* of conductor 116. The closer coupling of the trace 113*a* couples a signal of its polarity (e.g., a positive signal) onto these segments of conductors 111, 112. However, this relative proximity changes after the crossover 213*a*, wherein the trace 116*e* is nearer the forwardmost segment of trace 111*e* and the rearwardmost segment of trace 112*a* than is the trace 113*e*, and can, consequently, negate or compensate for the above-described coupling between the trace 113*a* and the traces 111*a*, 112*a* by coupling an opposite signal (e.g., a negative signal) onto these segments of the conductors 111, 112. Conductors 113 and 116 switch positions again after the crossover 213*b*, such that the trace 113*i* is nearer to the rearwardmost segment of trace 111*e* and the forwardmost segment of trace 112*e* than is the rearward segment of the trace 116*i* (with the resulting being coupling of a positive signal onto the conductors 111, 112). Finally, the conductors 113, 116 switch positions again after the crossover 213*c*, such that the trace 116*m* is nearer to the trace 111*i* and the forwardmost segments of the trace 112*e* than is the trace 113*m*; again, by switching positions relative to the traces of conductors 111, 112 after the crossover 213*c*, the trace 116*m* can compensate for coupling that occurred between the trace

113*i* and the conductors 111, 112 prior to the crossover 213*c* by coupling a negative signal onto the conductors 111, 112.

The opposite effect can be observed with respect to the conductors 117, 118 of Pair 4 and the conductors 113, 116 of Pair 3. Initially, trace 116*a* is much nearer to (and therefore more closely couples with) trace 118*a* and the initial segment of trace 117*a* than is trace 113*a* of conductor 113. The closer coupling of the trace 116*a* couples a signal of its polarity (to continue with the example from above, a negative signal) onto these segments of conductors 117, 118. This relative proximity changes after the crossover 213*a*, wherein the rearwardmost segment of trace 113*e* is nearer the forwardmost segment of trace 118*e* and the rearwardmost segment of trace 117*a* than is the trace 116*e*, and can, consequently, negate or compensate for the above-described coupling between the trace 116*a* and the traces 117*a*, 118*a* by coupling a positive signal onto the conductors 111, 112. Conductors 113 and 116 switch positions again after the crossover 213*b*, such that the trace 116*i* is nearer to the rearwardmost segment of trace 118*e* and the forwardmost segment of trace 117*e* than is the rearward segment of the trace 113*i* (with the resulting being coupling of a negative signal onto the conductors 117, 118). Finally, the conductors 113, 116 switch positions again after the crossover 213*c*, such that the trace 113*m* is nearer to the trace 113*i* and the forwardmost segments of the trace 117*e* than is the trace 116*m*; again, by switching positions relative to the traces of conductors 117, 118 after the crossover 213*c*, the trace 113*m* can compensate for coupling that occurred between the trace 116*i* and the conductors 117, 118 prior to the crossover 213*c* by coupling a positive signal onto the conductors 117, 118.

In keeping with the criteria that any modifications may still allow for a "Nominal Plug" response, the conductors 114, 115 of Pair 1 can be crossed over (for example, at crossovers 214*a*, 214*b*, 214*c*) in relation to the crossovers 213*a*, 2123*b*, 213*c* of the conductors 113, 116 of Pair 3 such that the inductive crosstalk for standards compliance is maintained.

In some embodiments, the distances between the crossovers for the various conductor pairs can conform to Table 1 below.

TABLE 1

| Length (in.) Between: | Pair 1 | Pair 2 | Pair 3 | Pair 4 |
|---|---|---|---|---|
| Cable to 1st Crossover | 0.110" | 0.070" | 0.070" | 0.070" |
| Cable to 2nd Crossover | 0.250" | 0.210" | 0.210" | 0.210" |
| Cable to 3rd Crossover | 0.390" | 0.350" | 0.350" | 0.350" |

In addition, any capacitive coupling that causes undesired mode conversion can be compensated by adding additional capacitors to the circuit design. By adding the appropriate value capacitors from the opposite trace of Pair 3 to Pair 2 and Pair 4 (see FIG. 5B), the differential nature of the signal on Pair 3 again can result in little or no net coupling of signal. As an example, the capacitors 121, 122, 127, 128 can form capacitance of between about 0.04 and 0.35 picoFarads.

It can be seen that, by selecting the components of a plug that connect an entering cable and the exiting blades of the plug that contact a mating jack, the coupling between individual conductors of one pair (such as Pair 3) and both of the conductors of another pair (such as Pair 2 or Pair 4) can be controlled such that undesirable differential to common mode conversion is reduced or negated while maintaining the required output crosstalk for a nominal plug (such as those set forth in TIA/EIA 568-B.2-1, Annex E, Tables E.3 and E.4, which are hereby incorporated herein by reference).

Figure 7:
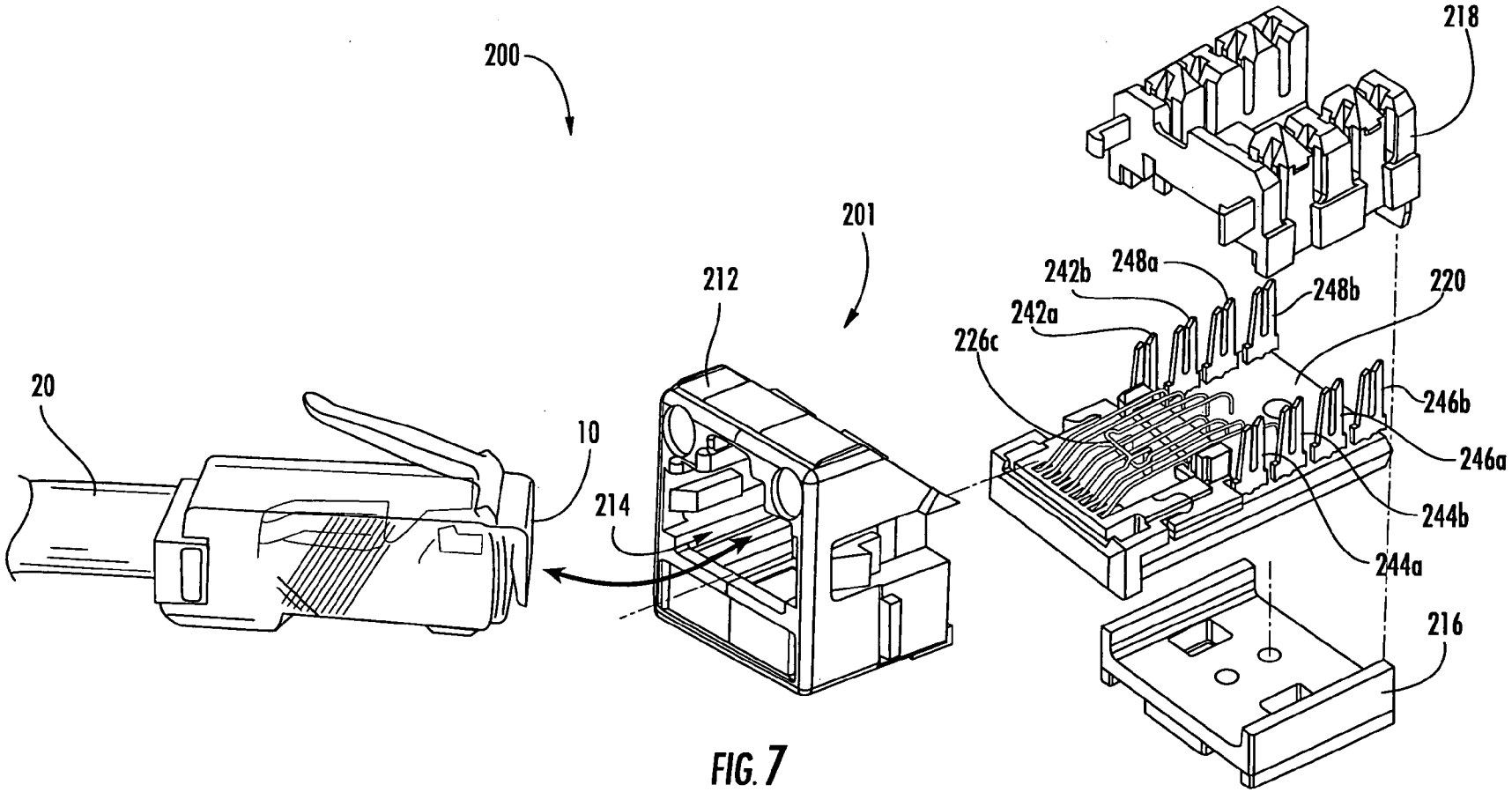
FIG. 7 is a perspective view of a communications assembly according to embodiments of the present invention.
Figure 7A:
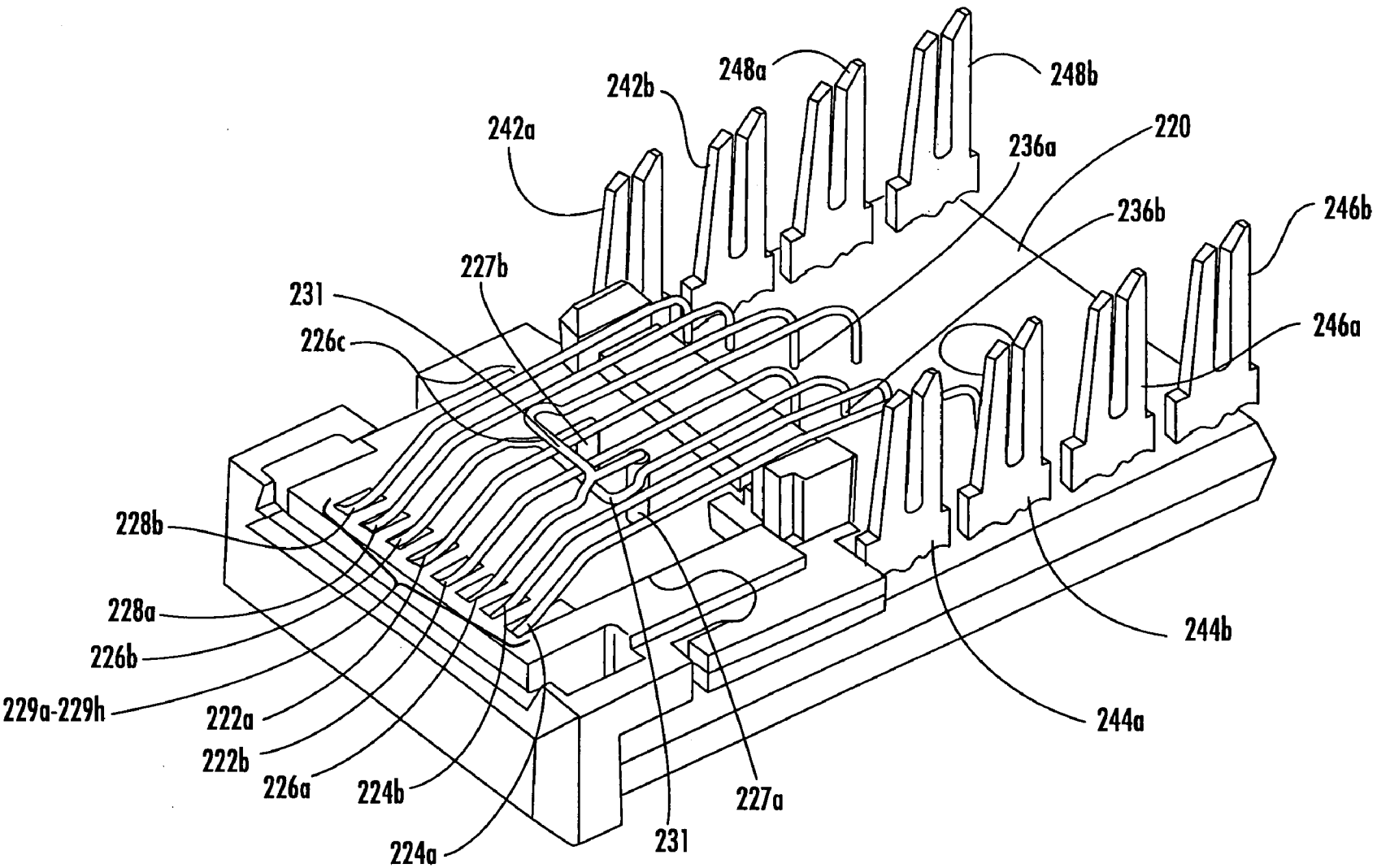
FIG. 7A is an enlarged perspective view of the wiring board of the communications jack shown in FIG. 7.

In some embodiments, it may be possible to select the output crosstalk to optimize the mated response to a particular jack for even more predictable crosstalk performance. An exemplary plug-jack assembly 200 is illustrated in FIGS. 7 and 7A, in which a jack 201 is shown (this jack is described in U.S. patent application Ser. No. 11/044,088, incorporated by reference hereinabove). The jack 201 includes a jack frame 212 having a plug aperture 214, a cover 216 and a terminal housing 218. A wiring board 220 includes IDCs 242*a*–248*b* mounted thereon. Contact wires 222*a*–228*b* are mounted to the wiring board 220. At their free ends, the contact wires 222*a*–228*b* fit within slots 229*a*–229*h* located at the forward end of the wiring board 220 and are positioned to mate with the blades of a plug inserted into the plug aperture 214. With the exception of the crossover region 226*c*, described in greater detail below, the contact wires 222*a*–228*b* follow generally the same profile until they bend downwardly into their respective mounting apertures in the wire board 220. Conductive traces on the wiring board 220 provide signal paths between the contact wires 222*a*–228*b* and the IDCs 242*a*–248*b*.

Referring now to FIG. 7A, the contact wires 226*a*, 226*b* form the crossover 226*c* with the assistance of supports 227*a*, 227*b*. Each of the contact wires 226*a*, 226*b* includes a transversely-extending crossover segment 231 that travels either over (in the case of the contact wire 226*a*) or under (in the case of contact wire 226*b*) the contact wires 222*a*, 222*b*. Each of the contact wires 226*a*, 226*b* also includes a support finger that extends rearwardly from the crossover segment 231 to rest atop a respective support 227*a*, 227*b*.

In this configuration, the assembly 200 can provide improved performance by addressing differential to common mode crosstalk in both the plug (i.e., prior to the contact region of the plug and jack) and in the jack (after the contact region). As such, the plug and jack can be tuned with the other to provide enhanced crosstalk performance.

Those skilled in this art will appreciate that the configuration of the plug may vary and still be encompassed by the present invention. For example, the lengths and/or shapes of the traces described and illustrated above may vary. The capacitors may be omitted, or other capacitors may be added as desired. The traces and/or capacitors may be deposited on different layers of the substrate. The traces may be replaced with other components, such as leadframes or the like, that have parallel segments that can generate inductive coupling and/or sections that can generate capacitive coupling. In some embodiments, only capacitive elements or only inductive elements may be used. Other variations may be recognized by those skilled in this art.

Moreover, in other embodiments other structures for the conductors themselves may be used, particularly if the connector is a jack rather than a plug. As examples, the conductors may be formed from a lead frame or conductive wire. They may include an "eye" to connect to a PWB and a contact region to contact another connector. The conductors themselves may be configured such that contact is made with a contact pad or other portion of a conductor that is deposited on the PWB. Other variations will also be recognized as suitable for use with this invention by those skilled in this art.

The invention will now be described in greater detail in the following non-limiting example.

EXAMPLE

A "conventional" Nominal Plug was modeled using HFSS Finite Element software, available from Ansoft Corporation. In addition, a "balanced" plug of the configuration illustrated in FIGS. 4A–5B above was also modeled. Mixed mode analysis was then performed on the conventional and balanced plugs.

Figure 6:
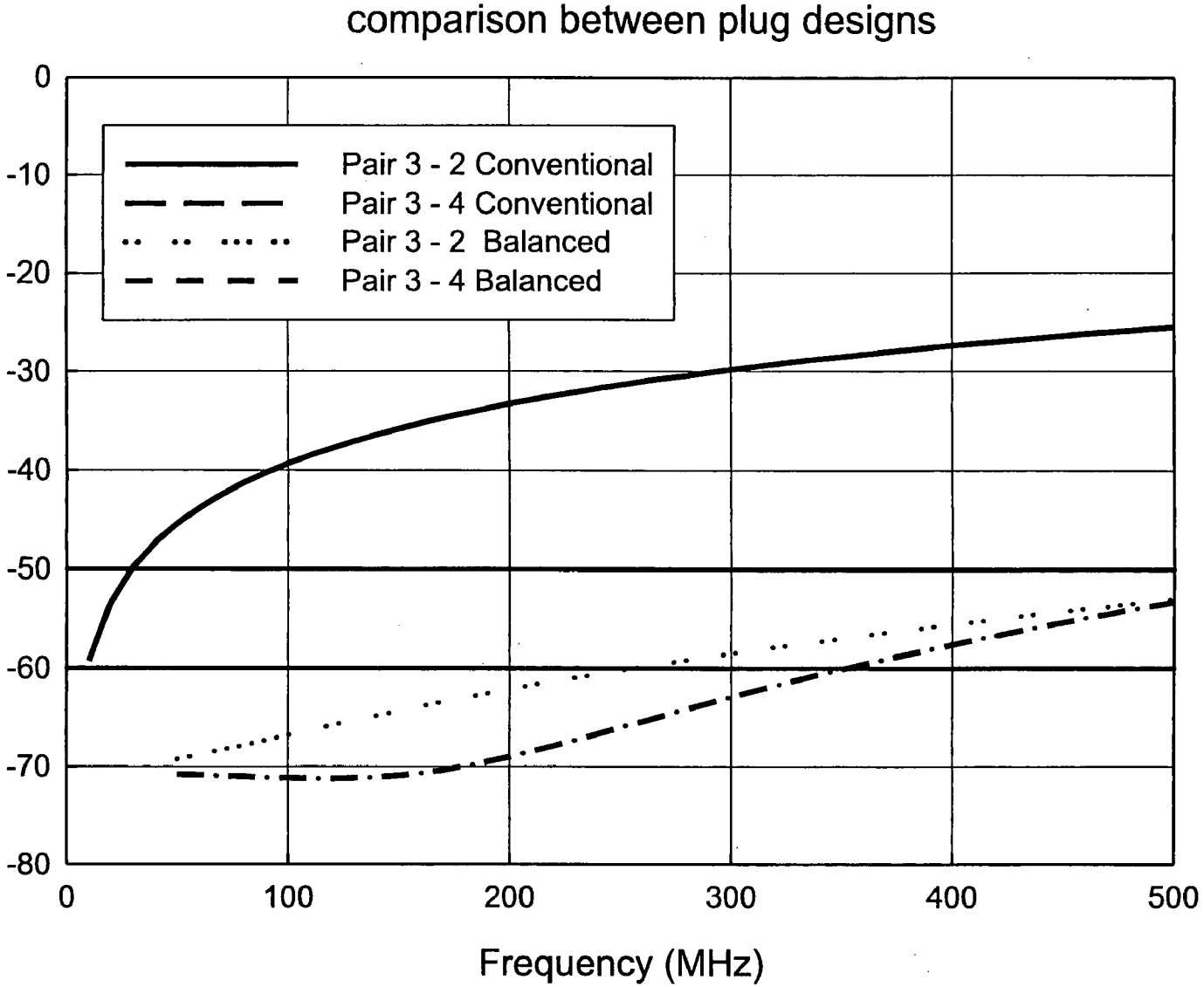
FIG. 6 is a graph plotting alien crosstalk as a function of frequency for a conventional plug and a plug according to embodiments of the present invention.

The results from the mixed mode analysis are shown in FIG. 6 (the curves for Pair 3-2 and Pair 3-4 were identical for the conventional plug; hence, only one curve is visible in FIG. 6; it represents both pair combinations). As can be seen from the curves of FIG. 6, the inclusion of compensating inductive and capacitive crosstalk in the balanced plug significantly reduced the degree of mode conversion for both pair combinations compared to that of a conventional plug, particularly at elevated frequencies. Consequently, a plug of this configuration should produce less crosstalk to a mating jack, which can reduce the degree of compensation necessary in the jack for desired performance.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications plug for mating with a communications jack, the plug comprising:

a first conductor and a second conductor that are adjacent to one another in a contact region of the plug and that together form a second pair of conductors;

a fourth conductor and a fifth conductor that are adjacent to each other in the contact region of the plug and that together fonn a first pair of conductors;

a third conductor that is disposed between the second conductor and the fourth conductor in the contact region of the plug; and a sixth conductor that is adjacent to the fifth conductor in the contact region of the plug, the third and the sixth conductor together forming a third pair of conductors that sandwiches the first pair of conductors in the contact region of the plug;

wherein the communications plug is configured so that when the third pair of conductors is excited by a differential signal, the differential to common mode crosstalk induced from the third pair of conductors onto the second pair of conductors is substantially cancelled; and wherein the communications plug is further configured so that when the second pair of conductors is excited by a differential signal, the differential to common mode crosstalk induced from the second pair of conductors onto at least one of the first or third pairs of conductors is substantially cancelled.

2. The communications plug defined in claim 1, further comprising a seventh conductor and an eighth conductor that are adjacent to one another in the contact region of the plug and that form a fourth pair of conductors, the seventh conductor being adjacent to the sixth conductor in the contact region of the plug, wherein each of the first, second and fourth pairs of conductors includes at least one crossover.

3. The communications plug defined in claim 1, wherein the third conductor and the sixth conductor are arranged to couple differing amounts of signal energy onto each of the fourth and fifth conductors.

4. The communications plug defined in claim 1, wherein the third pair of conductors includes three crossovers.

5. The communications plug defined in claim 1, further comprising a capacitor between the sixth conductor and at least one of the first and second conductors.

6. The communications plug defined in claim 2, wherein each of the first, second, third and fourth pairs of conductors includes three crossovers.

7. The communications plug defined in claim 2, wherein the third pair of conductors includes at least one crossover.

8. The communications plug defined in claim 6, wherein at least some of the crossovers are implemented on a on a printed circuit board.

9. The communications plug defined in claim 2, further comprising a capacitor between the third conductor and at least one of the seventh and eighth conductors.

10. A method of controlling the signal being output by a communications plug when a balanced signal is applied, comprising:

positioning a first pair of conductors relative to a dielectric substrate;

positioning a second pair of conductors relative to a dielectric substrate;

positioning a third pair of conductors relative to a dielectric substrate; and positioning a fourth pair of conductors relative to a dielectric substrate;

wherein the positions of the first, second, third and fourth pairs of conductors are selected to substantially cancel differential to common mode coupling from at least two of the pairs of conductors to each of the other pairs of conductors.

11. The method of claim 10, wherein the conductors of each of the first, second and fourth pairs of conductors include a crossover.

12. The method of claim 10, wherein the conductors of the third pair of conductors include at least two crossovers.

13. The method of claim 10, wherein the third pair of conductors is one of the at least two of the pairs of conductors.

14. A communications connection assembly, the assembly comprising a plug and a jack that receives the plug, wherein the plug comprises:

first and second pairs of electrical conductors;

the first and second pairs of conductors being arranged in a first plug region of the plug such that a first conductor of the first pair is selectively positioned to be closer to both of the conductors of the second pair than is a second conductor of the first pair, wherein in a second plug region of the plug the second conductor of the first pair is selectively positioned to be closer to both of the conductors of the second pair than the first conductor of the first pair;

and wherein the jack comprises:

first and second pairs of electrical conductors;

the first and second pairs of conductors being arranged in a first jack region of the jack such that a first conductor of the first pair is selectively positioned to be closer to both of the conductors of the second pair than is a second conductor of the first pair, wherein in a second jack region of the jack the second conductor of the first pair is selectively positioned to be closer to both of the conductors of the second pair than the first conductor of the first pair;

wherein each of the plug and the jack includes a contact region, the plug and jack contact regions contacting each other when the plug and jack are in a mated condition in which the conductors of the plug are electrically connected with the conductors of the jack.

15. The assembly defined in claim 14, wherein the first conductor of the plug first pair is electrically connected with the first conductor of the jack first pair, and the second conductor of the plug first pair is electrically connected to the second conductor of the jack first pair.

16. The assembly defined in claim 15, wherein the plug includes a third pair of conductors, the plug third pair of conductors being sandwiched by the plug first pair of conductors, and wherein the jack includes a third pair of conductors, the jack third pair of conductors being sandwiched by the jack first pair of conductors, and wherein each of the conductors of the plug third pair is electrically connected with a respective one of the conductors of the jack third pair.

17. A communications plug for mating with a communications jack, the plug comprising:

a first conductor and a second conductor that are adjacent to one another in a contact region of the plug and that together form a second pair of conductors;

a fourth conductor and a fifth conductor that are adjacent to each other in the contact region of the plug and that together form a first pair of conductors;

a third conductor that is disposed between the second conductor and the fourth conductor in the contact region of the plug;

a sixth conductor that is adjacent to the fifth conductor in the contact region of the plug, the third and the sixth conductor together forming a third pair of conductors that sandwiches the first pair of conductors in the contact region of the plug;

a seventh conductor and an eighth conductor that are adjacent to one another in the contact region of the plug and that form a fourth pair of conductors;

wherein the third pair of conductors includes at least two crossovers; and wherein at least one of the first pair, second pair or fourth pair includes at least one crossover.

18. The communications plug defined in claim 17, wherein at least one of the crossovers is implemented on a printed circuit board.

19. The communications plug defined in claim 17, wherein the second pair of conductors includes at least one crossover and wherein the fourth pair of conductors includes at least one crossover.

20. The communications plug defined in claim 17, wherein the first pair of conductors includes at least one crossover.

21. The communications plug defined in claim 17, wherein each of the first, second, third and fourth pairs of conductors includes at least two crossovers.

22. The communications plug defined in claim 17, further comprising a first capacitor between the third conductor and at least one of the seventh and eighth conductors and a second capacitor between the sixth conductor and at least one of the first and second conductors.

23. A communications plug for mating with a communications jack, the plug comprising:

a first conductor and a second conductor that are adjacent to one another in a contact region of the plug and that together form a second pair of conductors;

a fourth conductor and a fifth conductor that are adjacent to each other in the contact region of the plug and that together form a first pair of conductors;

a third conductor that is disposed between the second conductor and the fourth conductor in the contact region of the plug;

a sixth conductor that is adjacent to the fifth conductor in the contact region of the plug, the third and the sixth conductor together forming a third pair of conductors that sandwiches the first pair of conductors in the contact region of the plug;

a seventh conductor and an eighth conductor that are adjacent to one another in the contact region of the plug and that form a fourth pair of conductors;

wherein the first through eighth conductors are arranged so as to substantially cancel the differential to common mode crosstalk from the conductors of at least two of the pairs of conductors onto each of the other pairs of conductors.

24. The communications plug defined in claim 23, wherein the at least two of the pairs of conductors comprises the third pair of conductors and the second pair of conductors.

25. The communications plug defined in claim 23, wherein each of the first through eighth conductors terminates in a blade.

26. The communications plug defined in claim 23, wherein each of the first, second and fourth pairs of conductors includes at least one crossover.

27. The communications plug defined in claim 23, wherein each of the first, second, third and fourth pairs of conductors includes at least three crossovers.

28. The communications plug defined in claim 24, wherein the first through eighth conductors are arranged so as to also substantially cancel the differential to common mode crosstalk from the conductors of the fourth pairs of conductors onto the first, second and third pairs of conductors.

29. The communications plug defined in claim 26, wherein the third pair of conductors includes at least one crossover.

* * * * *

UNITED STATES PATENT AND TRADEMARK OFFICE

CERTIFICATE OF CORRECTION

PATENT NO. : 7,201,618 B2
APPLICATION NO. : 11/340368
DATED : April 10, 2007
INVENTOR(S) : Ellis et al.

It is certified that error appears in the above-identified patent and that said Letters Patent is hereby corrected as shown below:

Column 13,

Line 41: Please correct "fonn" To read --form--

Signed and Sealed this

Twenty-sixth Day of June, 2007

JON W. DUDAS
*Director of the United States Patent and Trademark Office*